US009951595B2

(12) United States Patent
Akinlade et al.

(10) Patent No.: US 9,951,595 B2
(45) Date of Patent: Apr. 24, 2018

(54) PRESSURE SWING SOLVENT ASSISTED WELL STIMULATION

(71) Applicant: Statoil Canada Limited, Calgary (CA)

(72) Inventors: Olajide Ganiyu Akinlade, Calgary (CA); John Hiram Palmer, DeWinton (CA); Fred Uwaifo, Calgary (CA)

(73) Assignee: STATOIL CANADA LIMITED, Calgary, Alberta (CA)

( * ) Notice: Subject to any disclaimer, the term of this patent is extended or adjusted under 35 U.S.C. 154(b) by 0 days.

(21) Appl. No.: 15/240,501

(22) Filed: Aug. 18, 2016

(65) Prior Publication Data

US 2017/0051596 A1 Feb. 23, 2017

(30) Foreign Application Priority Data

Aug. 18, 2015 (CA) ..... 2900711

(51) Int. Cl.
*E21B 43/18* (2006.01)
*E21B 43/24* (2006.01)
*E21B 43/16* (2006.01)

(52) U.S. Cl.
CPC ..... *E21B 43/18* (2013.01); *E21B 43/168* (2013.01); *E21B 43/2408* (2013.01)

(58) Field of Classification Search
None
See application file for complete search history.

(56) References Cited

U.S. PATENT DOCUMENTS 3,771,598 A * 11/1973 McBean ..... E21B 43/30 166/245
4,132,269 A * 1/1979 Chasteen ..... E21B 43/20 166/268
4,385,662 A 5/1983 Mullins et al.
6,318,464 B1 * 11/2001 Mokrys ..... E21B 43/168 166/252.1
6,769,486 B2 8/2004 Lim et al.
(Continued)

FOREIGN PATENT DOCUMENTS

CA 2698898 C 10/2012
CA 2 778 135 A1 11/2012
(Continued)

*Primary Examiner* — Anuradha Ahuja
(74) *Attorney, Agent, or Firm* — Birch, Stewart, Kolasch & Birch, LLP

(57) ABSTRACT

A method of initiating or accelerating the establishment of fluid communication between injection and production wells located in a formation, including injecting sufficient solvent into the wellbores of the wells such that the solvent occupies more than the horizontal sections of the wells; pressurizing the solvent column in the injection wellbore and optionally also the solvent column in the production wellbore by injecting gas such that the pressures at the toe and heel of the horizontal section of the injection well and optionally the production well are greater than a fracture pressure of the formation; maintaining the pressure in the injection wellbore and optionally also the production wellbore; depressurizing the injection wellbore and optionally the production wellbore, either simultaneously or consecutively in the case where both wellbores have been pressurized; and repeating the pressurization and depressurization steps for at least one more cycle to generate pressure swings.

21 Claims, 1 Drawing Sheet

(56) References Cited

U.S. PATENT DOCUMENTS

Figure 1:
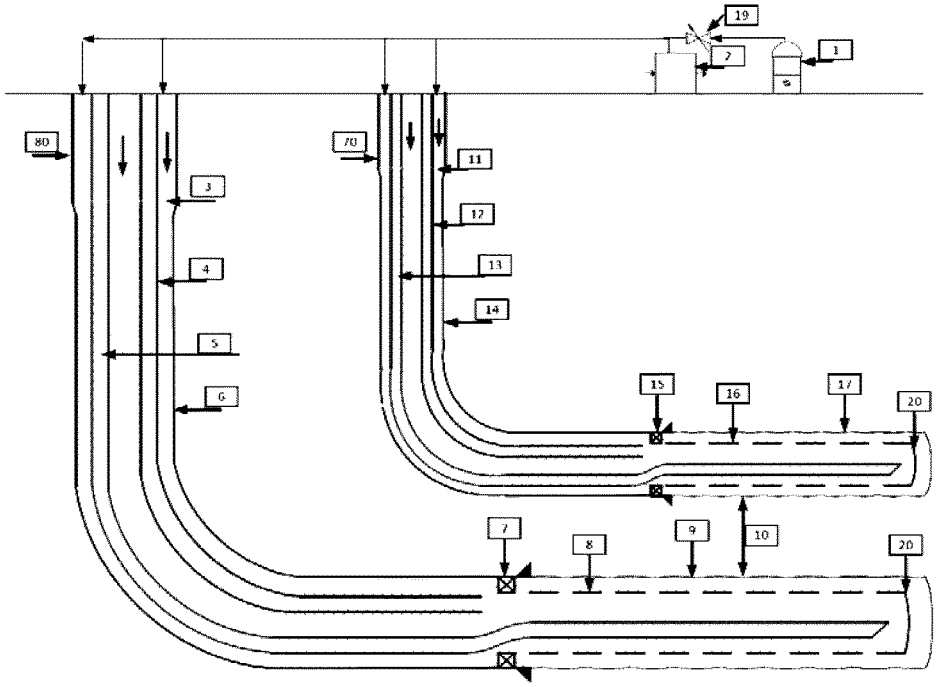

| | | | | |
|---|---|---|---|---|
| 8,607,866 | B2 | 12/2013 | Fang et al. | |
| 2003/0015321 | A1 | 1/2003 | Lim et al. | |
| 2010/0282644 | A1* | 11/2010 | O'Connor | C10G 1/047 208/427 |
| 2011/0174488 | A1 | 7/2011 | Morris et al. | |
| 2012/0227965 | A1 | 9/2012 | Fang et al. | |
| 2013/0199779 | A1 | 8/2013 | Scott | |

FOREIGN PATENT DOCUMENTS

| | | | |
|---|---|---|---|
| WO | WO 2012/121711 | A1 | 9/2012 |
| WO | WO 2015/000065 | A1 | 1/2015 |

* cited by examiner

PRESSURE SWING SOLVENT ASSISTED WELL STIMULATION

FIELD OF THE INVENTION

The present invention relates to a method of solvent assisted well stimulation in which pressure swings are generated which give enhanced solvent penetration from the wellbore into the formation between well pairs, thus enabling much quicker establishment of fluids flow communication between the injection and production wells.

BACKGROUND OF THE INVENTION

Extra heavy hydrocarbons, e.g. bitumen, represent a huge natural source of the world's total potential reserves of oil. Present estimates place the quantity of extra heavy hydrocarbon reserves at several trillion barrels, more than 5 times the known amount of the conventional, i.e. non-heavy, hydrocarbon reserves. This is partly because extra heavy hydrocarbons are generally difficult to recover by conventional recovery processes and thus have not been exploited to the same extent as non-heavy hydrocarbons. Extra heavy hydrocarbons possess very high viscosities and low API (American Petroleum Institute) gravities which makes them difficult, if not impossible, to pump in their native state.

A number of methods have been developed to extract and process heavy hydrocarbon mixtures. The recovery of extra heavy hydrocarbons from subterranean reservoirs is most commonly carried out by thermal enhanced recovery method such as steam assisted gravity drainage (SAGD), cyclic steam stimulation (CSS) or in situ combustion (ISC). In these methods the heavy hydrocarbon is heated and thereby mobilised, by steam in the case of SAGD and by a combustion front in the case of ISC, to flow to a production well from where it can be pumped to the surface facilities. The transportability of the viscous heavy hydrocarbon mixture recovered is conventionally improved by dilution with a lighter hydrocarbon.

The thermal recovery processes currently used suffer from inherent drawbacks. These include the consumption of vast amounts of energy, usually in the form of increasingly expensive natural gas, in the production of steam and the concomitant high carbon dioxide emissions which occur. Of course it has already been recognised in the energy industry that carbon dioxide emissions must be managed better.

One of the ways in which steam assisted gravity drainage methods have been improved as a means of recovering extra heavy hydrocarbons such as bitumen is through solvent facilitated start-up means or so-called 'solvent soaks'. These methods accelerate start-up for steam assisted gravity assisted methods for the recovery of extra heavy hydrocarbons from a formation. Typically, such a method involves the following steps: forming a steam-assisted gravity drainage production well pair comprising an injection well and a production well within formation; soaking one or both of the wellbores of the well pair with a solvent (the pre-soaking stage); heating the wellbores of the well pair the pre-heating stage); injecting steam into the wellbores of the well pair (the squeezing stage); and then conducting steam-assisted gravity drainage production. Such methods are disclosed in WO-A-2012/121711, US 2013/0199779, WO-A-2015/000065 and U.S. Pat. No. 4,385,662.

There are, however, a number of problems that exist with these existing solvent soak SAGD production methods:

(a) They do not necessarily apply a pressure that is slightly greater than the mini-frac pressure (the fluid pressure required to create localized fractures in a formation when said fluid is injected into the formation) to the formation during the soaking period. As a consequence, mini-fractures/dilation in the near well region are unlikely to occur. Under such solvent soaking conditions, solvent penetration into the formation from a wellbore will only rely on the mobile water, which can be quite low in some reservoirs. With a low degree of mobile water in the reservoir, it significantly reduces the amount of solvent that can be pushed into the reservoir.

(b) Without liquid solvent convective movement in the porous media, the existing technology utilises a diffusion process (which is a slow process) for solvent-bitumen mixing. This might result in a limited solvent penetration.

(c) Squeezing solvent with steam during the solvent soaking period might preferentially push the solvent into an uncontrollable region, i.e., a region where the permeability is already high, thus making the solvent soaking less effective in the low permeability locations.

Various attempts have been made to address some of these problems, with varying degrees of success.

U.S. Pat. No. 6,769,486 is not a steam assisted gravity drainage production but it does disclose a solvent-soak process for recovery of heavy hydrocarbons. The process comprises injecting a viscosity reducing solvent of a fraction of said hydrocarbons into the reservoir at a pressure in the reservoir of above a liquid/vapour phase change pressure of a fraction of said solvent, the pressure in the reservoir also being sufficient to cause geomechanical formation dilation or pore fluid compression; allowing the solvent to mix with the hydrocarbons under pore dilation conditions; reducing the pressure in the reservoir to below the liquid/vapour phase change pressure of at least said fraction of said solvent thereby evincing solvent gas drive of said fraction of said hydrocarbons from said reservoir; and then, (d) repeating steps (a) to (c) as required. Unlike in SAGD, there is no injector/producer pair of wells.

CA 2778135 discloses an in situ bitumen recovery startup process that comprises injecting a solvent containing startup fluid into a first horizontal well, providing a pressure sink in a second horizontal well for pressure drive of the solvent toward the second well to mobilise the inter-well region, and establishing fluid communication between the first horizontal well and the second horizontal well.

Another example of a solvent soak system is disclosed in US 2011/0174488, in which solvent is injected into the horizontal injector well located in the heavy hydrocarbon reservoir to accelerate fluid communication between it and the horizontal production well with which it is in fluid communication. According to one embodiment, the solvent can be displaced into the reservoir using a displacing fluid such as a gas.

Each of these methods employs solvent soaking, heating and the application of pressure to assist the recovery of heavy hydrocarbons (although U.S. Pat. No. 6,769,486 is not a steam assisted gravity drainage method). These are stated to help to improve heavy hydrocarbon recovery from reservoirs. However, there is still a need for a more efficient solvent soak method for the recovery of heavy hydrocarbons such as bitumen from reservoirs.

SUMMARY OF THE INVENTION

In the present invention, an improved method of solvent assisted well stimulation has been developed in which pressure swings are generated which give enhanced solvent penetration from the wellbore into the formation. This enables much quicker establishment of fluids flow communication between the injection and production wells upon steam circulation in steam assisted gravity drainage.

Thus, in a first embodiment the present invention provides a method of initiating or accelerating the establishment of fluid communication between injection and production wells located in a formation comprising heavy hydrocarbons, each well having a substantially vertical section and a substantially horizontal section comprising a heel and a toe, the method comprising the following steps:

(a) injecting sufficient solvent into the wellbores of the injection and production wells that the solvent more than occupies the substantially horizontal section of said wells;
(b) pressurising the solvent column in the injection wellbore and the production wellbore by the injection of gas such that the pressures at the toe and heel of the horizontal section of the injection well and optionally the production well are greater than the formation fracture pressure;
(c) maintaining the pressure in the injection wellbore and the production wellbore by the continuous gas pressurisation of the or each wellbore to accelerate solvent penetration into the reservoir formation;
(d) depressurising the injection wellbore and the production wellbore, either simultaneously, consecutively or stepwise the differentials in pressure between the two resulting in backflow of a mixture of solvent and heavy hydrocarbons into the horizontal sections of the production well and/or injection well; and
(e) repeating the pressurisation and depressurisation steps (b) to (d) for at least one more cycle to generate pressure swings that provide pressure differentials between the injection well and the production well and between the two wells and the reservoir formation to drive penetration of the solvent into the formation in the region between the horizontal portions of the wells and mobile fluids moving back and forth within the formation, thus creating enhanced convection of solvent/solvent-heavy hydrocarbon in the porous media of the formation around the well and in the region between the two wells.

In a second embodiment of the present invention there is provided a method of initiating or accelerating the establishment of fluid communication between injection and production wells located in a formation comprising heavy hydrocarbons, each well having a substantially vertical section and a substantially horizontal section comprising a heel and a toe, the method comprising the following steps:

(f) injecting sufficient solvent into the wellbores of the injection and production wells that the solvent more than occupies the substantially horizontal section of said wells;
(g) pressurising the solvent column in the injection wellbore by the injection of gas such that the pressures at the toe and heel of the horizontal section of the injection well are greater than the formation fracture pressure;
(h) maintaining the pressure in the injection wellbore by the continuous gas pressurisation of the injection wellbore to accelerate solvent penetration into the reservoir formation;
(i) depressurising the injection wellbore and either simultaneously, consecutively or step-wise pressurising the production wellbore by the injection of gas such that differentials in pressure are created between the two wells resulting in backflow of a mixture of solvent and heavy hydrocarbons into the horizontal sections of the production well and/or injection well; and
(j) repeating the pressurisation and depressurisation steps (g) to (i) for at least one more cycle to generate pressure swings that provide pressure differentials between the injection well and the production well and between the two wells and the reservoir formation to drive penetration of the solvent into the formation in the region between the horizontal portions of the wells and mobile fluids moving back and forth within the formation, thus creating enhanced convection of solvent/solvent-heavy hydrocarbon in the porous media of the formation around the well and in the region between the two wells.

FIGURES

Figure 2:
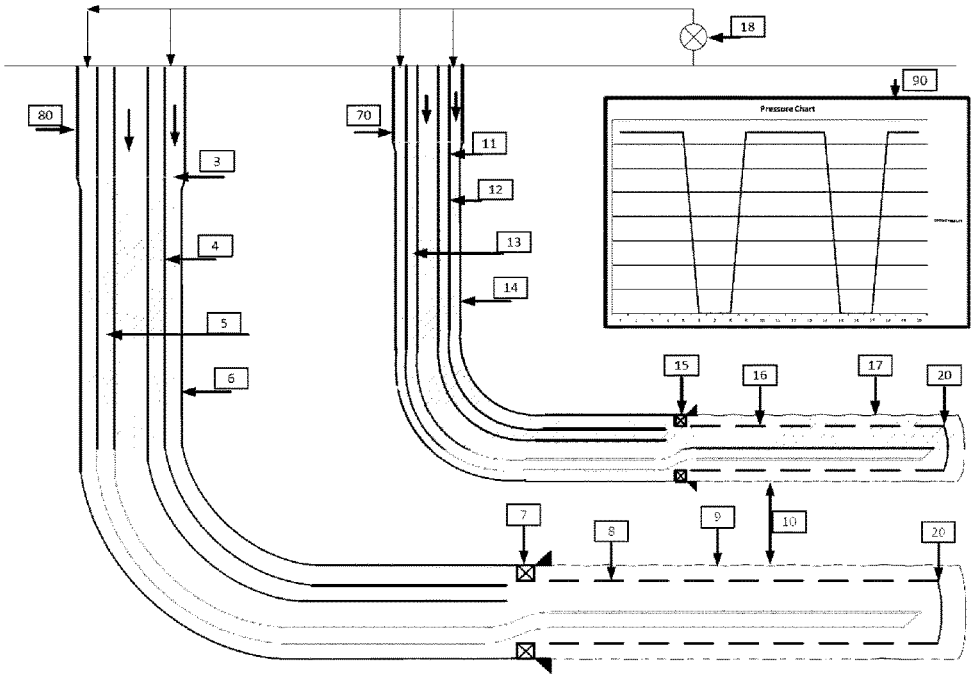

The present invention may be further understood by reference to the accompanying drawings, in which:

FIGS. 1 and 2 represent well arrangements according to the present invention comprising means for the injection of hydrocarbon solvent and gas into one or both of the injection and production wells and means of depressurising the wells.

DETAILED DESCRIPTION OF THE INVENTION

Unlike previous solvent soak methods such as that disclosed in WO-A-2012/121711, where dilation of the formation is obtained through continuously squeezing solvent with steam injection, the pressure swing generated in the steps of the methods of the present invention provides pressure differentials between the injection and production wells, and between the well and inter-well region. This drives solvent penetration into the inter-well region in the reservoir and mobile fluids moving back and forth within the reservoir formation, thus creating enhanced convection of solvent/solvent-heavy hydrocarbon in the porous media around the well and in the inter-well region. The enhanced convective effect accelerates solvent penetration in the near well formation and solvent-heavy hydrocarbon mixing in porous media, during the solvent soaking period.

The pressure swing operation approach to implement solvent soaking in the near well/inter-well region effectively utilises the mobile water to enhance the better solvent penetration. Furthermore, the pressure swing between the injection and production wells loaded with solvent, at appropriate pressure conditions (i.e., with the pressure in the solvent-loaded wellbores at a pressure greater than the reservoir fracture pressure, preferably slightly greater) helps to cause formation of mini-fracs in, dilation in and/or dilation of the formation in the near well and inter-well regions, which significantly increases the transmissibility of the fluids.

The methods of the present invention are for the recovery of heavy hydrocarbon from heavy hydrocarbon containing formations. As used herein heavy hydrocarbon refers to a mixture of hydrocarbon that comprises a greater proportion of hydrocarbons having a higher molecular weight than a relatively lighter hydrocarbon mixture. Terms such as "light", "lighter", "heavier" etc. are to be interpreted herein relative to "heavy". Typical heavy hydrocarbons have an API gravity of less than about 20°, preferably less than about 15°, more preferably less than 12°, still more preferably less than 10°, e.g. less than 8°. It is particularly preferred if the API gravity of the heavy hydrocarbon recovered by the method of the present invention is from about 5° to about 15°, more preferably from about 6° to about 12°, still more preferably about 7° to about 12°, e.g. bitumen.

In a particularly preferred feature of the method of the present invention, a thermal recovery method is employed to recover heavy hydrocarbons from the formation after step (e) or step (j). Examples of suitable thermal recovery methods include steam assisted gravity drainage, cyclic steam stimulation, steam flooding and in situ combustion, with steam assisted gravity drainage being preferred. Where steam assisted gravity drainage is employed after step (e) or step (j), this preferably comprises the injection of steam into the formation.

The pressurisation and depressurisation steps (b) to (d) or (g) to (i) are typically repeated for several cycles, the exact number depending upon the geological attributes around the horizontal wellbore.

The amount of solvent injected into the wellbores of the injection and production wells should be sufficient to prevent direct contact between the pressurising gas and the formation.

The pressure in the injection wellbore and optionally also the production wellbore is maintained by the continuous gas pressurisation of the or each wellbore in step (c) or the injection wellbore only in step (g) of the second alternative for a period of from 1 day to 3 months, preferably 1 week to 1 month. In steps (b) to (d), it is usually preferred that both the production wellbore and the injection wellbore are pressurised by gas.

If only the injection wellbore is pressurised, then it should be pressurised with gas at an appropriate pressure under which the toe/heel horizontal section of the well is exerted at slightly above reservoir fracture pressure, while the production wellbore is kept at a low pressure. The differential pressure between the injection and production wells provides a drive to accelerate solvent penetration into the inter-well region from the injection well. After a few days (typically 1 day to 14 days, more typically 3 to 7 days), the production wellbore is pressurised with gas injection to the desirable pressure while the injection wellbore is depressurised. As a consequence, the differential pressure between the production well and injection well accelerates solvent penetration into the inter-well region from the production well, and there is a degree of solvent/solvent-heavy hydrocarbon backflow from the inter-well region to the injection well, which adds to the convective effect on the solvent-heavy hydrocarbon mixing in porous media.

Typically, the injection wellbore and, if pressurized, the production wellbore are depressurized in step (d) or step (i) by exhausting the gas.

In the first embodiment of the invention, wherein the injection wellbore and the production wellbore can both be pressurised with gas, in one preferred embodiment after the pressurization of both wellbores in step (b) both the injection wellbore and the production wellbore are depressurised simultaneously in step (d).

The wellbores of the injection and production wells can preferably be flushed with gas prior to the solvent injection step (a) or step (f). This cleans the wellbores of the injection and production wells after completion.

The injection and production wellbores may also be flushed with gas after depressurisation in step (d) or step (i), again to clean the wellbores. If this step is introduced, then sufficient solvent is injected into the wellbores of the injection and production wells that the solvent more than occupies the substantially horizontal section of said wells after the cleaning step.

Typically, the solvent used is a hydrocarbon, more preferably a light hydrocarbon fluid (such as toluene, xylene, diesel, butane, diluent, condensate, or any combination or mixture thereof).

The pressurising gas that is employed is preferably a non-condensable gas, e.g. methane or nitrogen.

The method of initiating or accelerating the establishment of fluid communication between injection and production wells located in a formation comprising heavy hydrocarbons of the present invention addresses a number of the problems associated with prior art methods such as the solvent soak method disclosed in WO-A-2012/121711.

1. Pressure swing solvent assisted well stimulation according to the present invention gives combined effects of enhanced solvent penetration from the wellbore into the reservoir, convection-enhanced solvent-heavy hydrocarbon (e.g. bitumen) mixing in porous media and the occurrence of mini-fracturing/dilation in the near- and inter-well region during the stimulation. This combination of effects more effectively changes the formation fluids make-up (from initial formation fluids of water and heavy hydrocarbon to water, solvent, and heavy hydrocarbon) in the near- and inter-well region, and mobilises the heavy hydrocarbon from enhanced solvent-heavy hydrocarbon mixing. The changed fluids composition in the near- and inter-well region, and the increased heavy hydrocarbon mobility, combined with the increased porosity due to formation of mini-fractures and/or formation dilation in the near- and inter-well region, enables much quicker establishment of fluids flow communication between the injection and production wells upon steam circulation.
2. The pressure swing solvent assisted well stimulation operation of the present invention does not require special facilities over that of delivery of solvent into the wellbores, with the exception of a non-condensable gas supply with adequate pressure control (e.g methane or nitrogen). It is a relatively simple method, and operation of the pressure swing solvent assisted well stimulation of the present invention enables it to be practical and cost effective to implement.

There are a number of further advantages associated with the method of initiating or accelerating the establishment of fluid communication between injection and production wells located in a formation comprising heavy hydrocarbons of the present invention:

1. The injected solvent will mix/dilute with the heavy hydrocarbon around the wellbores and in the reservoir formation by diffusion, dispersion and convection, to reduce heavy hydrocarbon viscosity and thus increase the mobility of the fluids between the injection well and the production well.
2. The exerted pressure on the liquid solvent in the method of the present invention provides a significant support to penetrate solvent far into the reservoir formation and to enhance solvent convective transfer through the porous media, leading to heavy hydrocarbon/solvent mixing. The exerted pressure on the solvent provides the differential pressure that drives liquid solvent to displace the mobile water in the porous media, while the flow of liquid solvent through the porous media, in contact with the heavy hydrocarbon phase, results in the convective solvent mass transfer into the heavy hydrocarbon phase in addition to the molecular diffusion of solvent in the heavy hydrocarbon, thus enhances solvent mixing with heavy hydrocarbon.
3. The presence of relatively high water saturation within low quality sand region and associated displacement of the water by the solvent (fingering) could have contributed to better performance observed within that locality. In the low quality sand region with low heavy hydrocarbon saturation, high water saturation, higher clay/fines content, and reduced permeability, solvent displacement of the mobile water during solvent injection period changes the local fluid saturation condition from $S_w+S_o$ to $S_{wirr}$ $S_{solv}+S_o$ (where Sw is the initial water; So is the oil saturation; Swirr is the irreducible water saturation; and Ssolv is the solvent saturation). Due to relatively low $S_o$ in the low quality region, $S_{solv}+S_o$ will likely lead to increased solvent dilution of the heavy hydrocarbon (higher solvent content in the solvent heavy hydrocarbon mixture), thus, achieving greater mobility enhancement to the oil phase, which becomes more fluid. If such solvent penetration/advancement occurs in a more localized fashion, or "fingering", it essentially helps create the "channeling" phenomenon in the low quality region, which still allows for better hot water/steam advancement in the steam circulation period.

4. The pressure swing created by the method of the present invention assists the movement of liquid solvent in the porous media, thus enhancing the convective solvent mass transfer into heavy hydrocarbon during the soaking period. The pressure swing provides pressure differentials to drive the mobile fluids moving back and forth within the reservoir formation, thus creating enhanced convection. The enhanced convective effect accelerates solvent-heavy hydrocarbon mixing. Also the diluted heavy hydrocarbon may be excavated in the "channels" during the depressurization period and fresh solvent refills the "channels" in the ensuing pressure swing cycles if so conducted, which further enhances the solvent mix/dilution with the heavy hydrocarbon thus creating bigger "channels" with high mobility fluids in the formation.
5. During steam circulation, solvent diffusivity increases as temperature increases, leading to an enhanced solvent dilution effect on the heavy hydrocarbon. In the soaking period (step (c) or step (h)), a portion of the injected solvent has mixed with the heavy hydrocarbon, leading to formation of solvent-heavy hydrocarbon mixture that is easier to flow, resulting in more significant convection of oil phase driven by differential pressure. During the subsequent steam circulation period, the region under solvent soaking is heated. As the temperature increases, the solvent diffusion into the heavy hydrocarbon is enhanced (fast static mass transfer effect). The combined effects from the increased convection of oil phase due to reduced viscosity of the solvent diluted heavy hydrocarbon and enhanced solvent diffusivity at high temperature condition, solvent dilution of heavy hydrocarbon is significantly accelerated.

FIGS. 1 and 2 represent a well arrangement according to the present invention. Both wells comprise an injector well 70 and a producer well 80 for steam assisted gravity drainage (SAGD) operations, typically used for oil recovery in an extra heavy oil reservoir. The vertical spacing between the injector well 70 and producer well 80 typically ranges from 4 to 8 meters and the horizontal sections of both the injector well and producer well are typically 600-1000 m long, more preferably 800 m long. It is worthwhile to mention that the steam is injected through the injector well 70 and fluid is produced through the producer well 80. Prior to SAGD start-up, a communication needs to be established between the injector well 70 and producer well 80.

A positive displacement pump unit 2 is used to circulate the solvent of a pre-determined volume through the producer well short tubing 4 and long tubing 5 strings into the wellbore. The solvent is displaced at matrix rate, taking into account the feed rate of the wellbore to ensure that an adequate volume is displaced as planned. To ensure uniform displacement across the liner and intermediate casing, the solvent is pumped down the long tubing string 5 and returns taken through the short tubing string 4. The long tubing string 5 landing depth is typically about 12 m away from the producer well 80 liner landing depth 20. The short string landing depth is behind the producer liner hanger 7 in the intermediate casing.

After the solvent has been displaced into the producer wellbore, surface gate valve 19 is controlled to begin solvent displacement into the injector well 70. This is done also by the positive displacement pump 2 through the injector well short tubing 12 and long tubing 13 strings. Tubing landing depth mirrors similar design of the producer well 80. The horizontal sections of the injector well 70 and producer well 80 that open to the immobile extra heavy reservoir 10 have a slotted liner or wire wrapped screen as a sand control media 8, 16. These are held up in the intermediate casing by a liner hanger 15. For both injector well 70 and producer well 80, solvent is oozed out from the horizontal wellbore through sand faces 9 and 17, respectively.

During post solvent displacement, the top of solvent 3 in the producer well is monitored through fluid level shots to determine the solvent height in the vertical column of the wellbore. A similar approach is taken for the injector well 70 top of solvent 11. There is a potential of initial solvent leak off into the formation surrounding of the wellbore. After the stabilization of solvent in the vertical column has been established, pressure is exerted in a swing fashion 90 on the solvent columns in both the injector well 70 and producer well 80 during the treatment time to maintain a target bottomhole pressure and enable mobile fluids to move back and forth within the reservoir formation, thus creating enhanced convection of solvent/solvent-oil in the porous media around the well and in the inter-well region. The desired pressure swings are achieved by applying gas pressure to the producer intermediate casing annulus 6 and injector intermediate casing annulus 14 from a gas cylinder 1 to create the pressure on the solvent columns in the wellbores and the wells are depressurised by exhausting the gas in the wellbores. A surface pressure gauge 18 is used to monitor the intermediate casing annular pressure.

The invention claimed is:

1. A method of initiating or accelerating establishment of fluid communication between an injection well and a production well located in a formation comprising heavy hydrocarbons, each well having a substantially vertical section and a substantially horizontal section comprising a heel and a toe, the method comprising the following steps:

(a) injecting an amount of solvent into wellbores of the injection and production wells such that the solvent occupies more than the substantially horizontal section of each well and forms a solvent column in each wellbore;
(b) pressurising the solvent column in the injection wellbore by injecting gas such that the pressures at the toe and the heel of the horizontal section of the injection well are greater than a fracture pressure of the formation;
(c) maintaining the pressure in the injection wellbore by continuous gas pressurisation of the injection wellbore to accelerate penetration of the solvent into the formation;
(d) depressurising the injection wellbore, wherein pressure differentials between the injection wellbore and the production wellbore result in backflow of a mixture of the solvent and heavy hydrocarbons into the horizontal sections of at least one of the production well and injection well; and (e) repeating steps (b) to (d) for at least one more cycle to generate pressure swings that provide pressure differentials (i) between the injection well and the production well and (ii) between the injection well, the production well and the formation to drive penetration of the solvent into the formation in a region between the horizontal sections of the injection well and the production well and to drive mobile fluids moving back and forth within the formation, thus creating enhanced convection of solvent and the mixture of solvent and heavy hydrocarbon in a porous media of the formation around the injection well and the production well and in the region between the injection well and the production well.

2. The method according claim 1, wherein a thermal recovery method is employed to recover heavy hydrocarbons from the formation after step (e).

3. The method according to claim 2, wherein the thermal recovery method is steam assisted gravity drainage.

4. The method according to claim 3, wherein said steam assisted gravity drainage is conducted by injecting steam into the formation.

5. The method according to claim 1, wherein the amount of solvent injected into the wellbores of the injection and production wells is sufficient to prevent direct contact between the pressurising gas and the formation.

6. The method according to claim 1, wherein the pressure in the injection wellbore is maintained by continuous gas pressurisation of the injection wellbore in step (c) for a period of from 1 day to 3 months.

7. The method according to claim 1, wherein the injection wellbore is depressurized in step (d) by exhausting the gas.

8. The method according to claim 1, wherein the injection wellbore and the production wellbore are flushed with gas prior to the step (a).

9. The method according to claim 1, further comprising a cleaning step where the injection and production wellbores are flushed with gas after the step (d) to clean the injection and production wellbores.

10. The method according to claim 9, wherein an amount of solvent is injected into the wellbores of the injection and production wells such that the solvent occupies more than the substantially horizontal section of each well and forms a solvent column in each wellbore after the cleaning step.

11. The method according to claim 1, wherein the solvent is a hydrocarbon.

12. The method as claimed in claim 11, wherein said solvent is toluene, xylene, diesel, butane, condensate, or any combination or mixture thereof.

13. The method according to claim 1, wherein the pressurising gas is a non-condensable gas.

14. The method according to claim 13, wherein the pressurising gas is selected from methane and nitrogen.

15. The method according to claim 1, further comprising:

(b1) in step (b), pressurising the solvent column in the injection wellbore and also the solvent column in the production wellbore by the injection of gas such that the pressures at the toe and the heel of the horizontal section of the injection well and the production well are greater than a fracture pressure of the formation;

(c1) in step (c), maintaining the pressure in the injection wellbore and also the production wellbore by continuous gas pressurisation of the injection wellbore and the production wellbore to accelerate penetration of the solvent into the formation;

(d1) in step (d), depressurising the injection wellbore and the production wellbore, either simultaneously or consecutively, wherein pressure differentials between the injection wellbore and the production wellbore result in backflow of a mixture of the solvent and heavy hydrocarbons into the horizontal sections of at least one of the production well and injection well; and (e1) repeating steps (b1) to (d1) for at least one more cycle to generate pressure swings that provide pressure differentials (i) between the injection well and the production well and (ii) between the injection well, the production well and the formation to drive penetration of the solvent into the formation in a region between the horizontal sections of the injection well and the production well and to drive mobile fluids moving back and forth within the formation, thus creating enhanced convection of solvent and the mixture of solvent and heavy hydrocarbon in a porous media of the formation around the injection well and the production well and in the region between the injection well and the production well.

16. The method according to claim 15, wherein after the step (c1), the injection wellbore and the production wellbore are both depressurised simultaneously in the step (d1).

17. The method according to claim 15, wherein a thermal recovery method is employed to recover heavy hydrocarbons from the formation after step (e1).

18. The method according to claim 15, wherein the pressure in the injection wellbore and the production wellbore is maintained by continuous gas pressurisation of both the injection wellbore and the production wellbore in step (c1) for a period of from 1 day to 3 months.

19. The method according to claim 15, wherein the injection wellbore and the production wellbore are depressurized in step (d1) by exhausting the gas.

20. A method of initiating or accelerating establishment of fluid communication between an injection well and a production well located in a formation comprising heavy hydrocarbons, each well having a substantially vertical section and a substantially horizontal section comprising a heel and a toe, the method comprising the following steps:

(f) injecting an amount of solvent into wellbores of the injection and production wells such that the solvent occupies more than the substantially horizontal section of each well and forms a solvent column in each wellbore;

(g) pressurising the solvent column in the injection wellbore by injecting gas such that the pressures at the toe and the heel of the horizontal section of the injection well are greater than a fracture pressure of the formation;

(h) maintaining the pressure in the injection wellbore by continuous gas pressurisation of the injection wellbore to accelerate solvent penetration into the formation;

(i) depressurising the injection wellbore and either simultaneously or consecutively pressurising the production wellbore by injecting gas such that differentials in pressure are created between the injection wellbore and the production wellbore resulting in backflow of a mixture of the solvent and heavy hydrocarbons into the horizontal sections of at least one of the production well and the injection well; and (j) repeating the steps (g) to (i) for at least one more cycle to generate pressure swings that provide pressure differentials (i) between the injection well and the production well and (ii) between the injection well, the production well and the formation to drive penetration of the solvent into the formation in a region between the horizontal sections of the injection well and the production well and to drive mobile fluids moving back and forth within the formation, thus creating enhanced convection of solvent and the mixture of solvent and heavy hydrocarbon in a porous media of the formation around the injection well and in the region between the injection well and the production well.

21. The method according to claim 20, wherein a thermal recovery method is employed to recover heavy hydrocarbons from the formation after step (j).

* * * * *